US005686930A

United States Patent [19]

Brydon

[11] Patent Number: 5,686,930

[45] Date of Patent: Nov. 11, 1997

[54] ULTRA LIGHTWEIGHT THIN MEMBRANE ANTENNA REFLECTOR

[76] Inventor: Louis B. Brydon, 2031 Birch Ave., San Carlos, Calif. 94070

[21] Appl. No.: 435,718

[22] Filed: May 5, 1995

Related U.S. Application Data

[63] Continuation-in-part of Ser. No. 189,193, Jan. 31, 1994, abandoned.

[51] Int. Cl.[6] ..... H01Q 15/14

[52] U.S. Cl. ..... 343/912; 343/897

[58] Field of Search ..... 343/897, 912, 343/915, 840; H01Q 15/14, 15/16

[56] References Cited

U.S. PATENT DOCUMENTS

| | | | |
|---|---|---|---|
| 2,742,387 | 4/1956 | Giuliani | 343/912 |
| 3,234,556 | 2/1966 | Tanner | 343/897 |
| 3,496,687 | 2/1970 | Greenberg et al. | 343/915 |
| 3,508,270 | 4/1970 | Cook | 343/915 |
| 4,635,071 | 1/1987 | Grounder et al. | 343/912 X |
| 5,178,709 | 1/1993 | Shimodaira et al. | 343/912 |

FOREIGN PATENT DOCUMENTS

| | | | |
|---|---|---|---|
| 6048602 | 3/1985 | Japan | 343/912 |

*Primary Examiner*—Donald T. Hajec
*Assistant Examiner*—Tho Phan

[57] ABSTRACT

Space antenna reflectors comprising composite membranes having a fabric core comprising high modulus fibers, such as of graphite, woven along three or more axes and encapsulated within a cured plastic as a single ply composite material, such reflectors having quasi isotropic strength properties, i.e., the same strength, thermal stability and distortion-resistance in substantially all directions although they are based upon a single, lightweight ply of woven graphite fabric. The present reflectors may have a molded or honeycomb support, for attachment to a spacecraft or satellite.

8 Claims, 3 Drawing Sheets

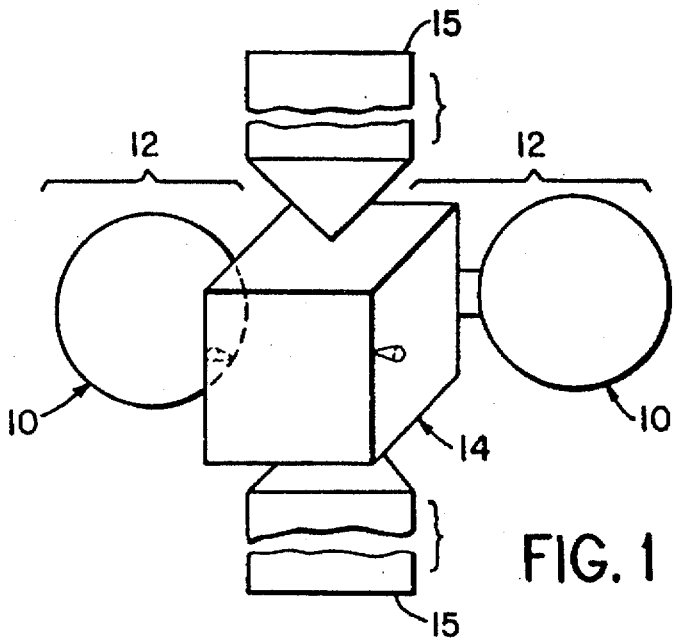
FIG. 1
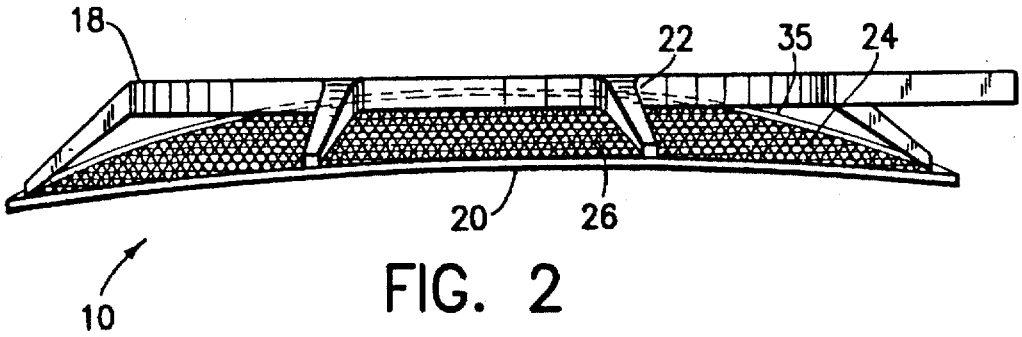
FIG. 2
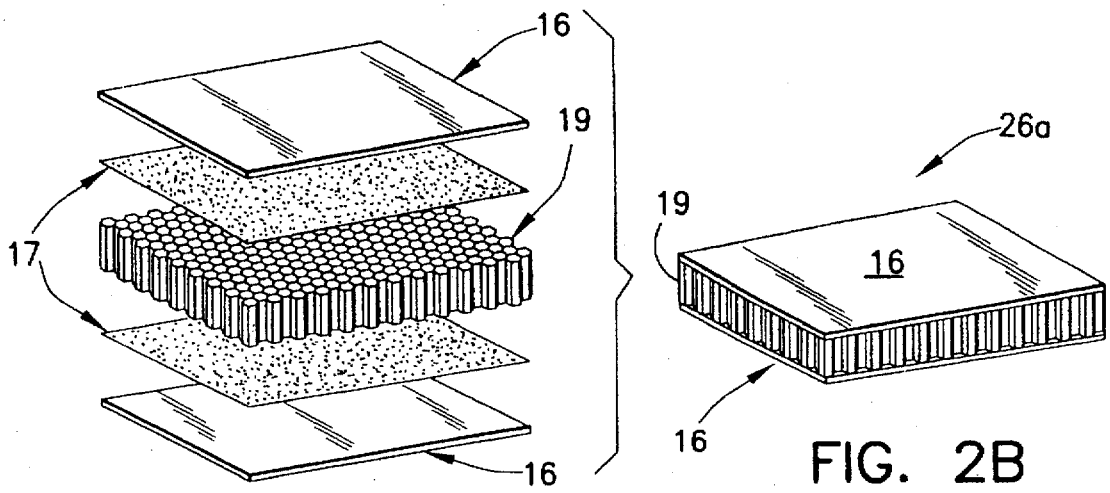
FIG. 2A
FIG. 2B

ULTRA LIGHTWEIGHT THIN MEMBRANE ANTENNA REFLECTOR

This is a continuation-in-part of application Ser. No. 08/189,193 filed on Jan. 31, 1994 now abandoned.

BACKGROUND OF THE INVENTION

1. Field of the Invention

The present invention relates to ultra lightweight reflectors for space antennae or satellite antennae which also have sufficient strength to resist distortion in space under the effects of substantial temperature variations, radiation exposure and space related disturbances.

2. State of the art

Electromagnetic- or microwave-reflective mirror antennae designed for use in space, particularly Earth orbit, generally have been a compromise between lightness of weight and strength or durability during exposure to the elements of space, particularly wide variations in temperature caused by exposure to sunlight and exposure to darkness.

Reference is made to Grounder et al U.S. Pat. No. 4,635,071 for its disclosure of a space reflector structure over which the present invention represents a substantial improvement with respect to overall weight while incorporating adequate strength and durability to function well in space environments.

The reflectors of the Grounder et al Patent, have a reflector member which has quasi-isotropic properties, i.e., it has the same strength, thermal stability and distortion-resistance in substantially all directions. These valuable properties are imparted by forming the reflector member from a plurality of plies of graphite fiber-reinforced epoxy tapes or fabrics, each ply comprising three layers of the tapes or fabrics which are oriented 60° relative to each other to provide the quasi-isotropic properties. While such reflectors have the desired strength and stability properties, they are relatively heavy, which limits the size of such antennae which are deliverable into space. Also they are relatively difficult and expensive to produce.

Reference is also made to Tanner U.S. Pat. No. 3,324,556 which relates to biconal, land-based grid wire antennae comprising two conductive wire arrays which are individually supported in spaced relation by means of a plurality of peripheral non-conductive poles and guy wires. The arrays are very large, such as 600 feet in diameter, and not self-supporting. Therefore they have no relationship to space deployment or usage.

The use of graphite-reinforced composites as space antenna reflector elements is well known, and reference is made to Jonda U.S. Pat. No. 4,092,453 which discloses wound laminates of carbon fiber-reinforced plastic composites, optionally supported on a honeycomb substrate. Reference is also made to U.S. Pat. Nos. 4,812,854 and 4,868,580 for their disclosure of antenna reflectors comprising reinforced fiber fabrics.

SUMMARY OF THE INVENTION

The present invention relates to ultra-lightweight, thermally-stable, single ply fabric antenna reflectors deployable for use in space as high frequency microwave reflectors which are resistive to distortion under the effect of substantial temperature variations, radiation exposure and space-related disturbances.

This invention is based upon the discovery that space antenna reflectors comprising composite membranes having a fabric core comprising graphite fibers woven along three or more axes and encapsulated within a cured plastic as a single ply composite material, have quasi isotropic properties, i.e., the same strength, thermal stability and distortion-resistance in substantially all directions although they are based upon a single, lightweight ply of woven graphite fabric.

Thus, the present reflectors have the isotropic properties of reflectors of the type disclosed by the aforementioned Grounder et al. patent but are substantially lighter in weight than such reflectors, due to their single ply construction, and are less expensive and easier to manufacture for the same reason.

The present reflectors may be of single ply, self-supporting structure, attached to a back-up frame structure connected to the antenna spacecraft, or may comprise a lightweight core, such as of honeycomb material, having bonded to the opposed faces thereof a single ply multi-axial fabric reflector layer.

BRIEF DESCRIPTION OF THE DRAWINGS

FIG. 1 illustrates a perspective view of a spacecraft (14) containing an antenna (12) and a pair of an associated reflectors (10) and vanes (15) according to one embodiment of the present invention;

FIG. 2 illustrates a side view of one embodiment of a reflector (10) of the present invention to be utilized in conjunction with the spacecraft (14) illustrated in FIG. 1;

FIG. 2A is a perspective view illustrating the formation of a triaxial woven graphite-honeycomb sandwich reflector member according to an embodiment of the present invention;

FIG. 2B is a perspective view illustrating the reflector member (26*a*) formed according to FIG. 2A;

DETAILED DESCRIPTION OF THE PRESENT INVENTION

Figure 3:
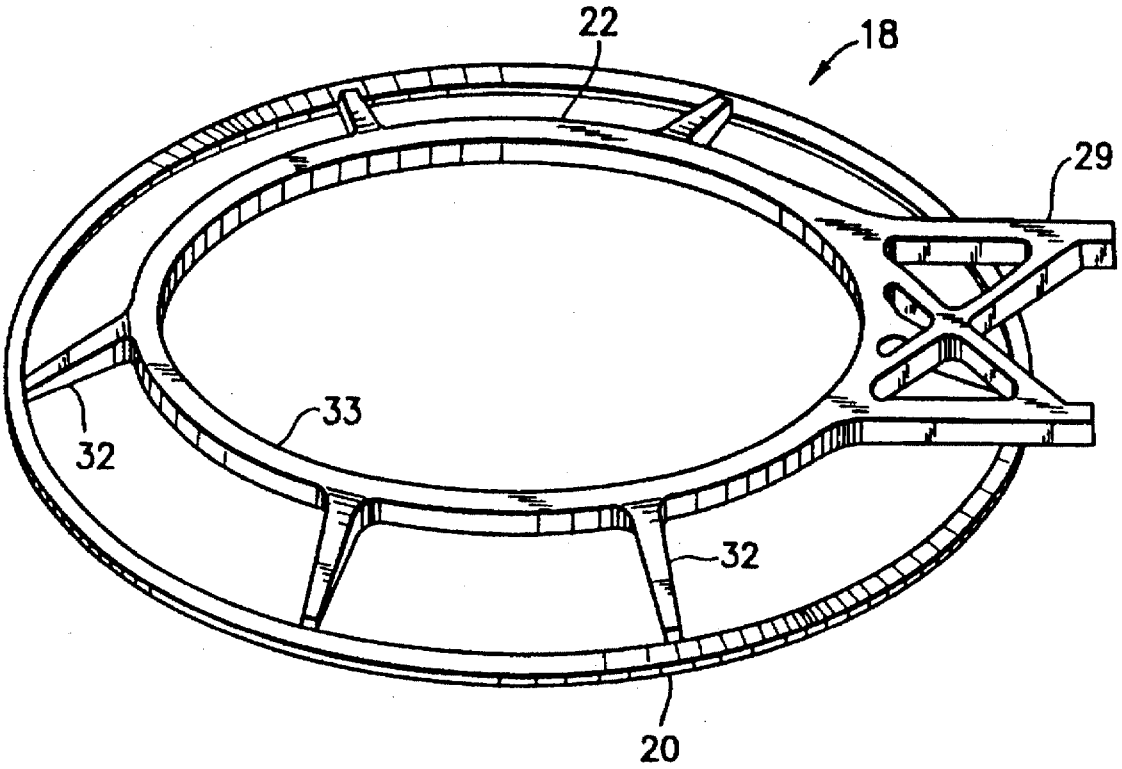
FIG. 3 illustrates a perspective view of the support (18) of the reflector of FIG. 2.

The present invention is concerned with an ultra-light weight thin membrane single ply reflector assembly 10, suitable for use with an antenna 12 on a spacecraft 14 such as a satellite as illustrated in FIG. 1. The spacecraft also has vanes 15 which do not form a part of the present invention. The thin membrane reflector assembly 10, as illustrated in FIG. 2, comprises a support 18 including an outer peripheral reflector ring 20 and a rear back-up or support frame portion 22. The reflector assembly 10 comprises a single ply fabric membrane 26 which comprises a multi-axially woven fabric 24 containing a multitude of high modulus fibers, such as graphite fibers oriented as described below. A typical size of the multi-axially reflector assembly 10, when properly supported, is within the range of 1 to 3 meters, but may be any size which is desired, and applicable, and deployable.

Figure 4:
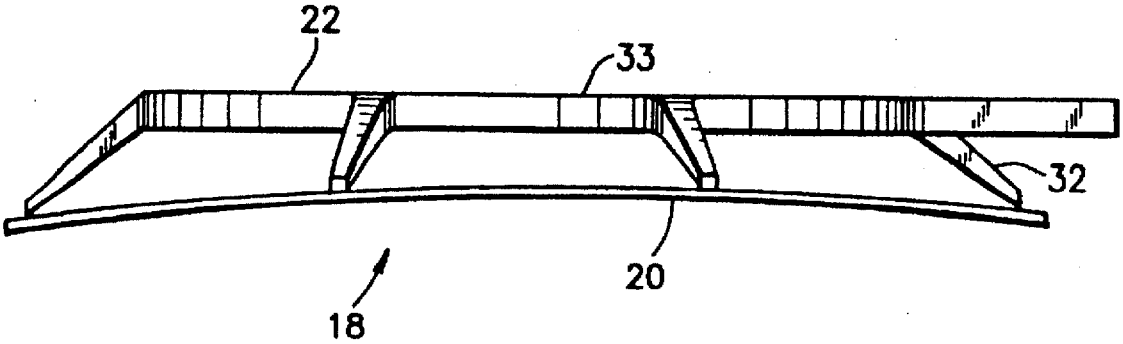
FIG. 4 illustrates a side view of the support (18) of FIG. 3.

Exploded perspective and side views of the back-up support 18 are illustrated in FIGS. 3 and 4, respectively. The support is molded to include the outer ring portion 20 and the rear support frame portion 22. Both the outer ring and the internal support portion are configured to support the reflector member 26 (illustrated in FIG. 2) in a planar, parabolic, hyperbolic, or any other geometric shape as is desired for the specific application. The support frame portion 22 is attached to the spacecraft 14 utilizing any conventional and suitable type of fastener affixed to a connection portion 29 of the support 20, shown in FIG. 3. The reflector membrane 26 preferably has a reinforcing core formed from a graphite honeycomb structure to provide a strong and lightweight structure and also provide a very low thermal expansion, as illustrated by FIGS. 2A and 2B. However any light weight material (such as synthetic foamed resin) which has a very low coefficient of expansion may be used as a reinforcing core. Such synthetic materials may be formed using any well known manufacturing technique, but foam molds have been found to be appropriate.

Referring to the embodiment of FIGS. 2A and 2B, the reflector member **26*a* is formed by laminating thin single ply membrane outer layers 16 to a central reinforcing core 19 of conventional lightweight honeycomb material, such as paper fiberboard, heat-resistant plastic, aluminum alloy, etc., by means of curable adhesive layers 17. Layers 16 comprise the single ply multi-axial woven fabric of high modulus fibers, such as graphite, encapsulated within a cured plastic composition, such as polycyanate ester resin, epoxy resin or other curable polymer systems conventionally used to form fiber-reinforced composite fabrics conventionally used in the aviation industry. As illustrated, the various layers are superposed and heat-bonded to form a reflector sandwich 26*a*. It will be apparent that the honeycomb core 19 will be formed in the desired size, shape or curvature, and that the outer reflector layers 16 will conform to the surface shapes of the core 19 to form the reflector member 26*a***.

Figure 5:
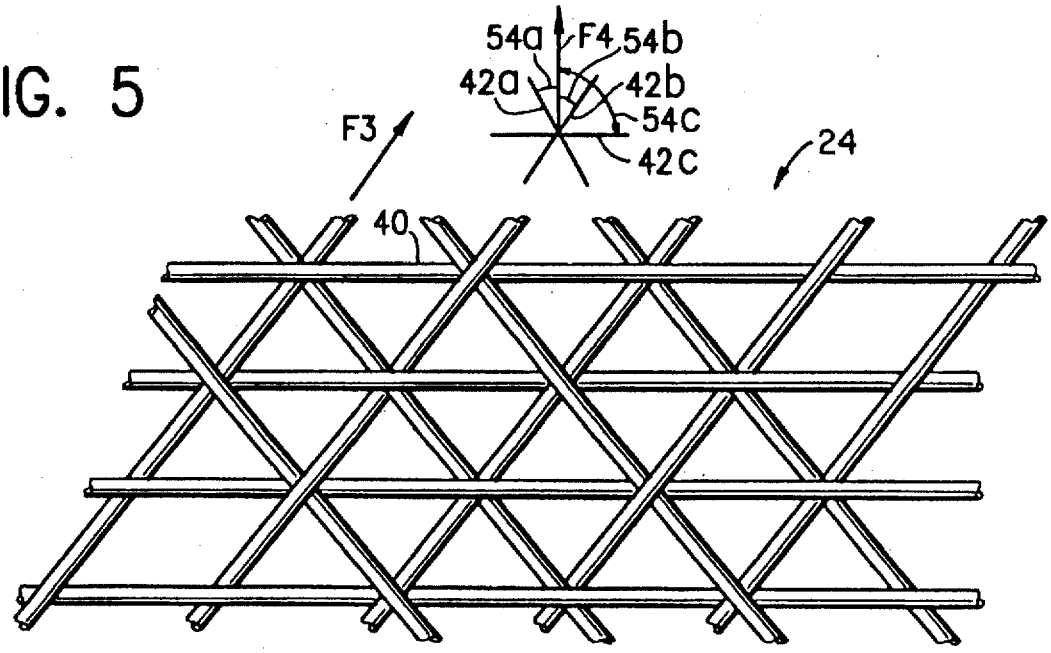
FIG. 5 illustrates an exploded view of one embodiment of the multi-axial fabric used in the reflector of FIG. 2.
Figure 6:
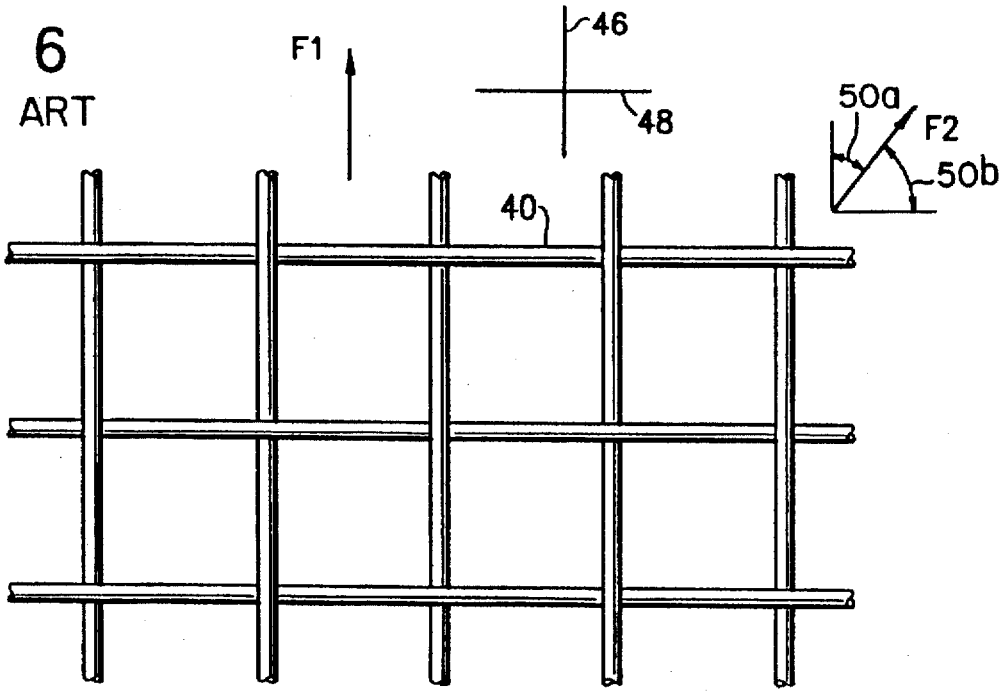
FIG. 6 PRIOR ART
FIG. 6 illustrates a similar view to FIG. 5 of a prior art bi-axial fabric weave.

The most essential feature of the present reflector members 26 is the encased or encapsulated single ply multi-axial woven fabric 24 which has quasi-isotropic properties due to the fact that it comprises fibers extending uniformly along at least three distinct axes, as illustrated by FIG. 5 of the drawings. thus the composite reflector member 26 is substantially more resistant to thermal expansion and contraction than conventional woven fabrics comprising fibers extending only at right angles relative to each other, as illustrated by FIG. 6.

A low coefficient of thermal expansion is critical in satellite applications because of the intense temperature variation between the side of the reflector which is facing the sun compared to the side of the reflector which is in the shade. The spacecraft temperature variation ranges from plus 130 degrees centigrade in the sun to minus 180 degrees centigrade in the shade. With this temperature variation it is essential that the coefficient of thermal expansion be very low, such as approximately 1 part expansion per million parts for each variation of one degree centigrade, in order for the satellite reflector to be reliably used in communication applications. Larger or smaller coefficients of expansion may be required for satellite reflectors with different applications.

The reflector membrane 26 of FIG. 2 is attached only to and supported only by spaced areas of the outer ring 20 of support member 18, i.e., only at discrete flexure attachment points. The rear support frame portion 22 includes a plurality of axial support fingers 32 and an internal ring 33. The outer ring 20 is supported by the plurality of support fingers 32 (preferably at least six) which are also affixed to, and supported by, the internal ring 33 which is not attached to the membrane 26. The support member 18 may be molded from uni-directional composites of fabric tape formed preferably from graphite or other high modulus fiber impregnated with curable resin composition which has a high modulus and low coefficient of thermal expansion. Such materials and manufacturing techniques may also be applied to mold the internal ring 33 and the support members 32. The rear support frame portion 22 is formed from a minimal number of tubular integrated parts, and is designed for a minimal weight. Multi-layer insulation may also be applied to protect all or part of the reflector and support structure from the thermal environments experienced in orbit. The front surface or face of the reflector member 26 may be left uncovered to avoid the thermal effects of paint or other covering.

As illustrated in FIG. 5, the thin multi-axial woven fabric 24 thereof is a single ply (in the approximate range from 0.010" to 0.040" thick) of high modulus (preferably graphite) fiber 40 woven as a uniform tri-axial open weave fabric which is pre-impregnated with a curable resin to form the reflector member 26. Such membrane dimensioning is usually applied to provide a member which is reflective to radiation of the microwave spectrum. Even though the above fabric material dimension range is inapplicable in the visible light or other short wavelength electro-magnetic spectrum (the radiation would pass through the membrane and/or deflect at random angles off the individual fibers), microwave radiation will interface with the 0.010" to 0.040" thick fabric as if it were a continuous material. Therefore such woven thin fabrics 24 are only suitable for high frequency or microwave applications.

While FIG. 5 illustrates a triaxial weave fabric, it should be understood that any uniform multi-axial weave may be used as long as the multi-axial is at least tri-axial. In a uniform tri-axial weave as illustrated in FIG. 5, for example, sets of fibers are oriented along three coplanar axes **42*a*, 42*b*, 42*c* with each axis forming an intersecting angle of approximately sixty degrees to each other axis. The fibers oriented along each axis are interwoven with fibers which are oriented along different axes. The advantages of a multi-axial weave fabric, shown in FIG. 5 is illustrated in comparison to a prior art bi-axial weave, shown in FIG. 6. The bi-axial weave will exhibit considerably higher deflection resistance when a distorting force F1 is applied in a direction substantially parallel to one of the axis 46, 48 as compared to when a diagonal distorting force F2 is applied at an angle 50*a*, 50*b* to both of the axis. The tri-axial weave of the present invention, as illustrated in FIG. 5, will display a much more uniform deflection resistance regardless of whether a distorting force F3 is applied substantially parallel to one of the axis 42*a*, 42*b*, 42*c*, or a distorting force F4 is applied at a non-zero angle 54*a*, 54*b*, 54*c* to each of the three axis 42*a*, 42*b*, 42*c* since the distorting force F4 usually is closer to parallel to one or more of the axes than F2 would be. This uniformity of deflection resistance (the material is quasi-isotropic in the plane of the fabric) not only ensures that the thin membrane will undergo a more constant deflection when a random force is applied to the fabric, but also ensures that the fabric 24 will be able to resist the type of force which would likely cause permanent distortion to the thin membrane 26. The tri-axial weave also ensures that a desired resistance against a force applied from any direction can be met without providing a substantial increase in weight to the reflector 10**.

The above configuration of isotropic single ply membrane 26 is ultra-light, and provides a stable, durable antenna reflector 10 for a communications satellite 14. The multi-axial woven fabric 24 of the single ply thin membrane 26 is very light, thermally stable, durable, responsive and provides a reflective surface at radio frequencies (RF) and microwave frequencies. The reflector member 10 can be formed with a planar surface, a parabola, a hyperbola, or any other desired surface shape. The single ply reflector membrane 26 is deformable or yieldable under the types of forces (either G-forces or contact forces) which the assembly 10 is likely to encounter when the spacecraft is being launched or deployed.

It is also possible that the thin reflector membrane 26 may be formed in some peculiar configuration to form a so-called "shaped" surface. Such shaped surfaces are configured so that radiation may be reflected off the surface of the membrane in a desired manner. For example, if the reflector membrane 26 is being used to apply radiation across a land-mass, it would be desired to confine the direction of the radiation to within the outlines of the landmass (which would usually be an irregular shape). It may be desirable to alter the configuration of the reflector surface such that a higher percentage of the transmitted or received radiation is being directed to or from the desired location. "Shaping" the membrane can assist in the above applications, among others. Another advantage of the present invention, compared to other more rigid reflectors, is that the shape of the thin single ply membrane 26 of the present system is easier to produce in different configurations. Certain prior art reflectors, since they are thicker and relatively rigid, are typically more difficult to shape precisely.

The ability to produce a thin reflector membrane 26 of only one ply improves the thermal stability both by lowering the thermal mass of the thin membrane 26 and by lowering the coefficient of thermal expansion (CTE) to almost zero, and also simplifies the manufacturing process considerably. The open weave of the fabric permits acoustic vibrational forces (pressure exerted by sound waves) to be relieved through the membrane surface. The acoustic vibration environment experienced during the launch of the satellite 14 is a critical design constraint for large light weight surfaces such as the present reflector assemblies 10.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. An ultra lightweight thin membrane space antenna reflector which is reflective of high frequency radiation, including microwaves, and has a low coefficient of thermal expansion, consisting of a composite of a single ply, single layer fabric woven of high strength, high modulus fibers and embedded within a cured polymer, said single ply, single layer fabric being woven from high strength fibers which are oriented along at least three distinct axes to provide said fabric with quasi-isotropic strength properties whereby it possesses the same strength, thermal stability and distortion-resistance in substantially all directions.

2. An antenna reflector according to claim 1 in which said fabric is a triaxially-woven fabric comprising graphite fibers.

3. An antenna reflector according to claim 1 in which said cured polymer comprises a polycyanate ester.

4. An antenna reflector according to claim 1 comprising a said thin membrane composite bonded to a support member.

5. An antenna reflector according to claim 4 in which said support member comprises a lightweight molded structure having an outer peripheral ring portion, spaced areas of which are bonded to the outer periphery of the thin membrane composite reflector as the sole areas of attachment and support for said thin membrane composite reflector, an inner ring portion spaced inwardly from said outer ring portion, and a plurality of radial support fingers connecting the inner and outer ring portions, to support the thin membrane composite reflector.

6. An antenna reflector according to claim 4 in which the support member further comprises extension members for attaching the reflector to a spacecraft.

7. An antenna reflector according to claim 1 in which said reflector comprises a lightweight honeycomb material bonded to said composite.

8. An antenna reflector according to claim 7 comprising a sandwich structure of a said lightweight honeycomb support member bonded to surface layers of said thin membrane composite materials.

* * * * *